US007740088B1

(12) United States Patent
Bar-Cohen et al.

(10) Patent No.: US 7,740,088 B1
(45) Date of Patent: Jun. 22, 2010

(54) ULTRASONIC ROTARY-HAMMER DRILL

(75) Inventors: Yoseph Bar-Cohen, Seal Beach, CA (US); Mircea Badescu, Arcadia, CA (US); Stewart Sherrit, La Crescenta, CA (US); Xiaoqi Bao, San Gabriel, CA (US); Steve Kassab, Hennosa Beach, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 168 days.

(21) Appl. No.: 11/928,069

(22) Filed: Oct. 30, 2007

(51) Int. Cl.
*E21B 10/36* (2006.01)

(52) U.S. Cl. ..... 175/415; 310/323.18; 310/323.19

(58) Field of Classification Search ..... 175/19, 175/414, 415; 299/14; 310/323.01–323.06, 310/323.12, 323.13, 323.16–323.19; 601/2; 602/22

See application file for complete search history.

(56) References Cited

U.S. PATENT DOCUMENTS 1,136,987 A * 4/1915 Wakfer ..... 175/415
1,745,351 A * 2/1930 Bishop ..... 175/298
2,214,970 A * 9/1940 Mooney ..... 175/242
2,651,148 A * 9/1953 Carwile ..... 451/165
3,219,131 A * 11/1965 Boyd ..... 175/92
3,352,369 A * 11/1967 Bodine, Jr. ..... 175/56
3,471,724 A * 10/1969 Balamuth ..... 310/26
3,619,671 A * 11/1971 Shoh ..... 310/325
4,036,309 A * 7/1977 Petreev et al. ..... 173/103
4,828,052 A * 5/1989 Duran et al. ..... 175/55
5,492,187 A * 2/1996 Neukirchen et al. ..... 175/394
5,549,170 A * 8/1996 Barrow ..... 175/55
5,733,074 A 3/1998 Stock et al.
5,779,403 A * 7/1998 Kleine et al. ..... 408/230
5,791,424 A * 8/1998 Moser et al. ..... 175/394
6,204,592 B1 * 3/2001 Hur ..... 310/323.18
6,431,294 B1 * 8/2002 Eddison et al. ..... 175/415
6,527,063 B2 * 3/2003 Rust et al. ..... 175/162
6,557,653 B2 * 5/2003 Hauptmann et al. ..... 175/305
6,640,914 B2 * 11/2003 Wisser et al. ..... 175/389

(Continued)

FOREIGN PATENT DOCUMENTS

WO WO 2007034462 A1 * 3/2007

OTHER PUBLICATIONS

Merriam-Webster Dictionary's definition of "vibrating" "oscillate" and "hammering", accessed Feb. 26, 2010.*

*Primary Examiner*—David J. Bagnell
*Assistant Examiner*—Blake Michener
(74) *Attorney, Agent, or Firm*—Mark Homer

(57) ABSTRACT

A mechanism for drilling or coring by a combination of sonic hammering and rotation. The drill includes a hammering section with a set of preload weights mounted atop a hammering actuator and an axial passage through the hammering section. In addition, a rotary section includes a motor coupled to a drive shaft that traverses the axial passage through the hammering section. A drill bit is coupled to the drive shaft for drilling by a combination of sonic hammering and rotation. The drill bit includes a fluted shaft leading to a distal crown cutter with teeth. The bit penetrates sampled media by repeated hammering action. In addition, the bit is rotated. As it rotates the fluted bit carries powdered cuttings helically upward along the side of the bit to the surface.

11 Claims, 3 Drawing Sheets

U.S. PATENT DOCUMENTS 6,810,973 B2 11/2004 Sved
6,863,136 B2 3/2005 Barr-Cohen et al.
6,968,910 B2 11/2005 Bar-Cohen et al.
7,070,367 B2 7/2006 Krenzer
7,128,172 B2 * 10/2006 Cosic et al. ..... 175/320
7,156,189 B1 1/2007 Bar-Cohen et al.
7,174,969 B2 2/2007 Drosie
7,175,506 B2 * 2/2007 Fiebelkorn et al. ..... 451/11
7,387,612 B2 * 6/2008 Pal et al. ..... 601/2
2003/0116355 A1 6/2003 Bar-Cohen et al.
2004/0007387 A1 1/2004 Bar-Cohen et al.
2006/0162961 A1 7/2006 Johnson
2006/0278433 A1 12/2006 Walker et al.
2007/0007045 A1 1/2007 Lorger et al.
2007/0251734 A1 * 11/2007 Koch et al. ..... 175/415
2009/0057013 A1 * 3/2009 Gourley et al. ..... 175/19
2009/0071725 A1 * 3/2009 Purcell ..... 175/415

* cited by examiner

ULTRASONIC ROTARY-HAMMER DRILL

STATEMENT OF GOVERNMENT INTEREST

The invention described hereunder was made in the performance of work under a NASA contract, and is subject to the provisions of Public Law #96-517 (35 U.S.C. 202) in which the Contractor has elected not to retain title.

BACKGROUND OF THE INVENTION

1. Field of the Invention

The present invention generally relates to the field of drilling, and more particularly, relates to apparatus for penetrating, sampling, probing, and testing of a medium.

2. Description of Prior Art

Effective probing, drilling and coring apparatus find use in a great number of areas such as, for example, planetary exploration, military, medical operations, construction, police investigations, geology, archaeology sports (for example hiking and rock climbing) and other games.

Existing drilling techniques are limited by the need for high axial forces, large power consumption, as well as a need to operate from a heavy platform to drill in non-horizontal and/or hard surfaces. The life of coring bits is markedly reduced by the breakdown of the binder that holds abrasive material on a bit surface.

Accordingly, the capability of existing rotary corers has limited application in power and mass constrained environments. As an example, a typical rotary corer that produces 10 mm cores in hard rocks requires at least 20 to 30 watts of power. Such drilling rigs cannot be duty cycled continuously without a loss of efficiency. In addition, drill motors can demand as much as three to four times surge current upon startup then during continuous operation.

Conventional rotary corers that, for example, produce 10 mm diameter cores which may require about 100-N to 150-N or more of axial preload and during core initiation, drill walk can induce torques on the drilling platform that may exceed 30 Nm and tangential forces of 100-N. The drill chatter delivers a low frequency, for example 2-10 Hz, high force perturbations on a drilling platform which requires conventional coring applications to utilize very stable and massive platforms.

In hard rock formations, conventional rotary drillers and corers lose an advantage that they sometimes demonstrate in soft materials. In hard rocks, conventional drillers stop drilling by shearing and spoliation and become grinders. The grinding process is accompanied by at least a 300% increase in consumed energy per unit length of the core. In addition, because the grinding mechanism is determined by the compression failure of the rock, the teeth of the corers must be re-sharpened frequently. Accordingly, sharpness of the bits must be monitored otherwise the heat generation at the tip may increase by a factor of up to 10 times. This increase is accompanied by a concomitant drop in drilling efficiency and often causes burning or melting of the drill bit.

Non-traditional drilling technologies, such as for example, lasers, electron beams, microwaves, hydraulic jets, are typically competitive only in applications that are not power limited. Down-the-well energy required to remove a unit volume of rock for so called "modern" technologies is about the same as grinding and melting, that is, three to five times higher than for shear drilling. Unfortunately, for modern technologies, the ratio of down-the-well power delivered versus input power generation is below several percent versus 10 to 30 percent for conventional drills. Accordingly, many space or power limited applications simply do not have enough power to employ a non-traditional drilling technique.

Hammering drills and particularly the Ultrasonic/Sonic Driller/Corer (USDC) as shown in various embodiments in various earlier-filed U.S. patents and applications offer a solution capable of coring into a variety of rocks and soils using low power and low axial load. The USDC is based on an ultrasonic/sonic actuator mechanism. The advantages of this are attractive for potential future robotic missions to explore the planets and moons.

Experiments have shown that the penetration rate of the USDC can be improved by a factor of ten by rotating the drill bit. This supplements the hammering action and provides for faster drilling rates and greater penetration depth. However, the increased speed of drilling results in more cuttings and requires removal of the cuttings.

It would be greatly advantageous to provide hammer drilling with rotation of the bit, where the bit is independently rotated by a motor to remove large volumes of powdered cuttings, and to provide a backup drilling action in case of failure of either rotary or hammering mechanism. It would also be advantageous to provide a bit design with flutes on the surface to remove the powdered cuttings.

SUMMARY OF THE INVENTION

It is a primary object of this invention to provide a hammering drill with increased penetration efficiency and increased efficiency of powdered cuttings removal.

It is another object to provide hammering drills combined with rotation of the bit for increased penetration and cuttings removal efficiency.

It is another object to provide a hammering drill in which the bit is independently rotated by a motor to both produce and remove a large volume of cuttings.

It is still another object to provide hammering drills that are light weight and consume low amounts of power/energy.

In accordance with the foregoing objects, the present invention is an ultrasonic/sonic actuator-based hammering drill having a two-section drill bit including a fluted shaft leading to a distal crown cutter with teeth. The ultrasonic/sonic actuator comprises a piezoelectric stack connected to an ultrasonic transducer horn, wherein the piezoelectric stack is maintained in compression between a backing and the horn by a prestress bolt to form the ultrasonic/sonic actuator. Further, the ultrasonic/sonic actuator is in contact with a free mass and the drill bit. The piezoelectric stack creates vibrations that are amplified by the horn. As the horn strikes the free-mass, momentum is carried into the bit, creating sonic pulses. These pulses cause a percussion effect between the bit and the rock and the rock fractures when its ultimate strain is exceeded. The bit penetrates sampled media by repeated hammering action. In addition, in the preferred embodiment the bit is rotated. To achieve this, a keyed shaft is inserted through the ultrasonic actuator. The shaft is connected on one side to a motor and on the opposing side to the drill bit, and thereby transmits the rotation from the motor to the drill bit. The drill bit comprises a section for accommodating the ultrasonic horn tip and the free mass, a means of coupling with the shaft, an outside fluted section, and a cutting crown section at the distal end. The crown cutter is defined by a series of cutting teeth and a set of channels on its external surface that corresponds to the flutes on the shaft, and this pattern increases the speed of cuttings removal and hence the drilling speed (and depth of penetration). As it rotates the fluted bit provides a removal path for the powdered cuttings to travel helically upward along the side of the bit to the surface. The combined hammering with slow speed rotation rapidly produces powdered cuttings. Moreover, the decoupled rotation mechanism works independently of the sonic action and provides redundancy in case of a failure of one drilling mechanism. The crown cutter provides a replaceable element for low cost operation.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

The present invention is a hammering drill based on an ultrasonic/sonic actuator that employs a unique drill bit and independent hammering actuator with rotary actuator for operation of the bit by a combination of hammering with rotation for increased penetration and cuttings removal efficiency.

Figure 1:
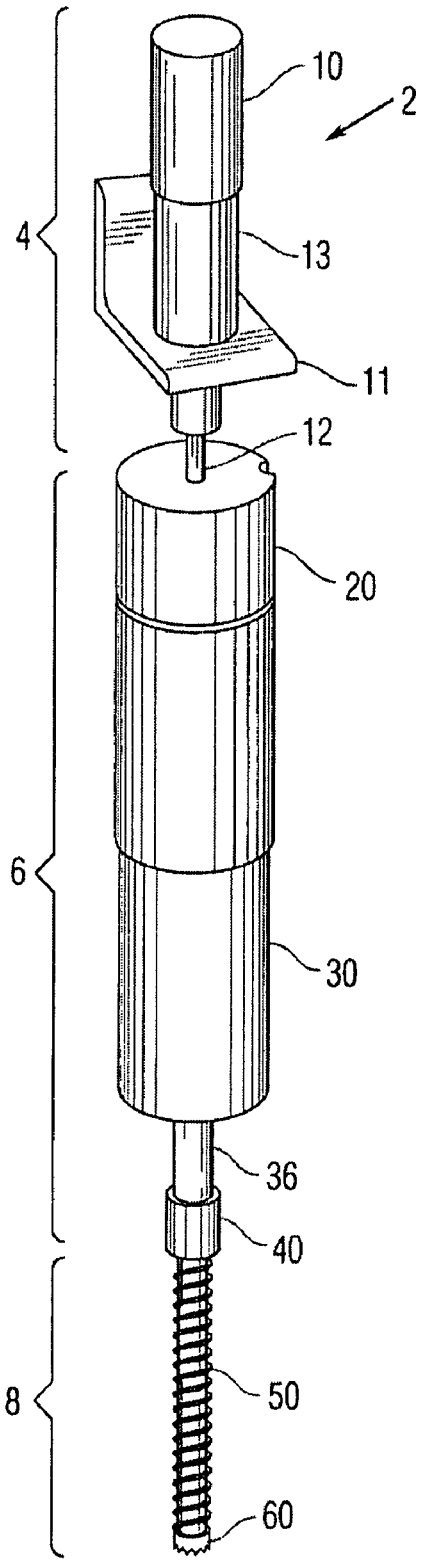
FIG. 1 is a perspective view of an exemplary embodiment of the hammering drill based on ultrasonic/sonic actuator 2.

FIG. 1 is a perspective view of an exemplary embodiment of the hammering drill based on ultrasonic/sonic actuator 2 that generally includes three main sections: a rotary section 4; hammering ultrasonic/sonic actuator section 6; and drill bit 8.

The hammering ultrasonic/sonic actuator section 6 further comprises a set of preload weights 20 mounted atop an ultrasonic/sonic actuator 30, the actuator 30 being connected via an ultrasonic transducer horn 36 to a free mass 40. The free mass 40 is sonically coupled to the drill bit 8.

The rotary section 4 further comprises a motor 10 mounted stationery on a bracket 11 or the like, the motor 10 being coupled through a drive shaft 12 that traverses the ultrasonic/sonic section 6 and is keyed into the drill bit 8.

Thus, both the rotary section 4 and hammering ultrasonic/sonic actuator section 6 drive the drill bit 8, one with rotary motion and one sonic vibration, and the two drives are completely independent.

Figure 2:
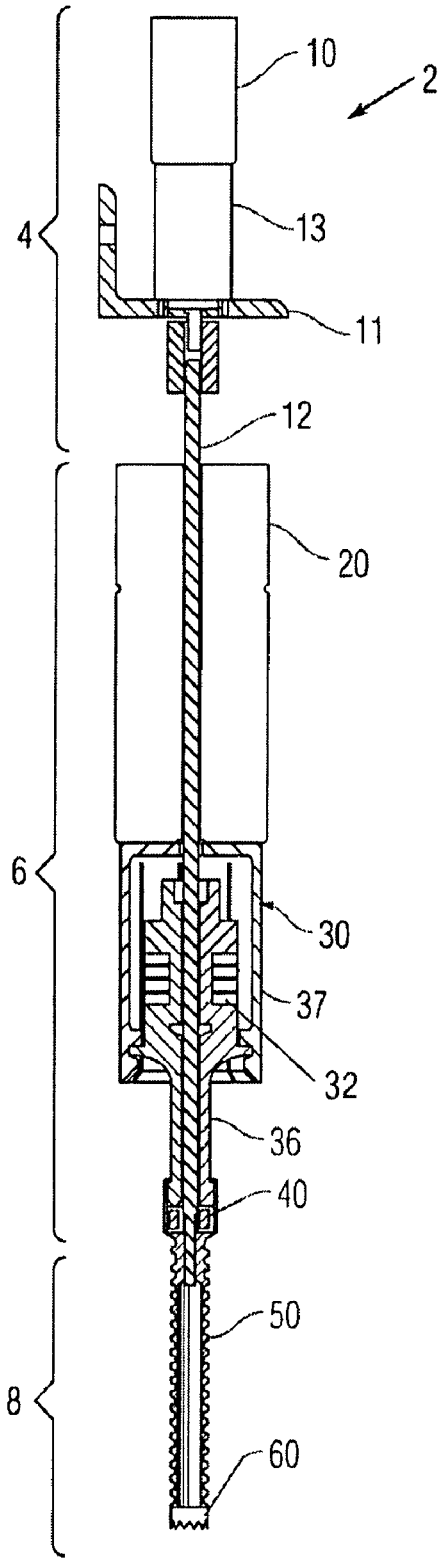
FIG. 2 is a cross-sectional view of the hammering drill based on ultrasonic/sonic actuator 2 as in FIG. 1.

FIG. 2 is a cross-sectional view of the hammering drill based ultrasonic/sonic actuator 2 as in FIG. 1. The ultrasonic/sonic actuator 30 further comprises a piezoelectric stack 32 that creates vibrations which are amplified by the ultrasonic transducer horn 36. As the horn 36 strikes the free-mass 40, momentum is carried into the drill bit 8, creating sonic pulses. These pulses cause a percussive effect between the bit 8 and the sample media (rock, for example), and the rock fractures when its ultimate strain is exceeded. The drill bit 8 penetrates the sampled media by repeated hammering action. The structure and operation of the ultrasonic/sonic actuator 30 is set forth in detail in U.S. Pat. No. 6,863,136 to Bar-Cohen et al. issued Mar. 8, 2005.

Figure 3:
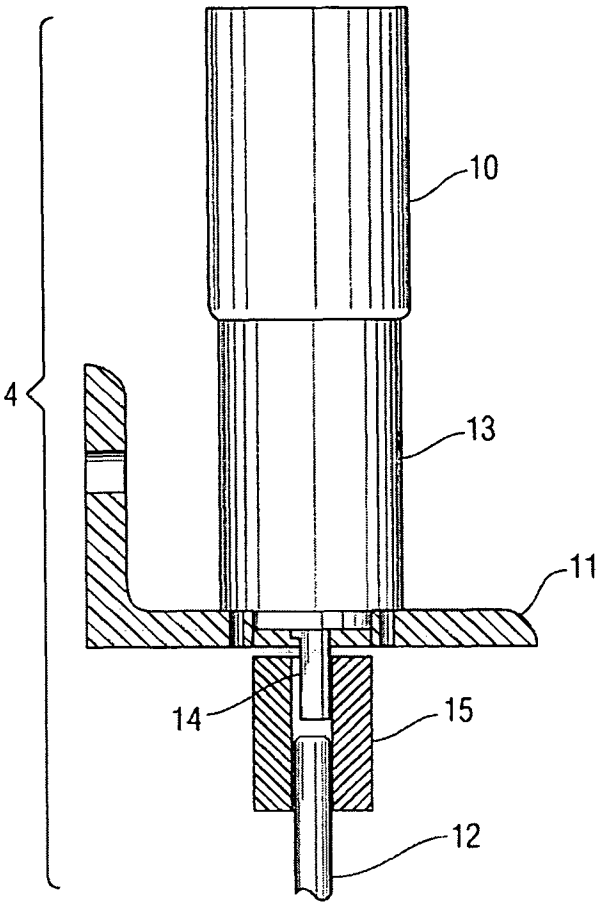
FIG. 3 is a close-up cross-section of the rotary section 4.

The actuator 30 and horn 36 may be coupled to one another in any conventional manner. For example, as shown in FIG. 3 of the cited U.S. Pat. No. 6,863,136 patent the crown cutter 60 and drill stem 50 communicates with the horn 36 via an extension that enters the horn 36 base and bears against a stop. A free mass 40 is disposed between the horn 36 and the drill stem 50 (leaving a gap between the free mass 40 and the horn 36 tip and/or free mass 40 and drill stem 50 base) for oscillating therebetween in response to actuator 30 vibrations. This free mass 40 oscillation is described in co-pending U.S. Pat. No. 6,863,136 to Bar-Cohen et al. issued Mar. 8, 2005. The free-mass 40 may be made of Maraging 300 steel or the like.

In operation, the horn 36 amplifies the ultrasonic vibrations that are induced by the piezoelectric stack 32 and impacts the free mass 40 that oscillates between the horn 36 and the drill stem 50. The free mass 40 allows the drill bit 8 to operate under a combination of the ultrasonic drive frequency (5 kHz and up) and a 10-5000 Hz sonic hammering. It is currently capable of high speed drilling (e.g., from 2 to 20 mm deep per watt-hour for a 6 mm diameter hole, in volcanic materials Basalt and Bishop Tuff respectively) using low axial preload (<5 N) and low average power (lower than 2 Watts average has been demonstrated). The oscillation of the free mass 40 provides for a hammering function and also causes migration of media debris around and through the drill bit 8 which effects self-cleaning of the bit. A combination of the actuator 30 and the free mass 40 forms an effective vibratory actuation mechanism that requires relatively low axial force that can be made to work at very low temperatures down to single digit Kelvin degrees to very high temperatures exceeding 800 degrees Kelvin (500 degrees C.).

Unfortunately, as explained previously the initial penetration rate will begin to degrade with increasing depth. In accordance with the present invention a separate mechanism is provided for rotating the bit 8, thereby allowing for faster drilling rates and greater penetration depth. Moreover, a particular (fluted) configuration of the bit 8 surface facilitates transport of debris out of the hole.

The rotary section 4 further comprises a motor 10 mounted stationery on a mounted bracket 11 or the like, the motor 10 rotor being coupled through a drive shaft 12 that traverses the entire hammering ultrasonic/sonic actuator section 6 and is keyed to the drill bit 8.

FIG. 3 is a close-up cross-section of the rotary section 4, which includes the motor 10 and an integral reduction gear-head 13 mounted on the mounted bracket 11. The specifications of the reduction gear-head 13 will depend on the chosen scale of the present system 2. However, in the illustrated embodiment a motor 10 along with a triple reduction gear train 13 that provides over 30 inch lbs. of torque has been found to be a sufficient combination. The motor 10/gear-head 13 is in this example seated vertically in a 90-degree angle bracket 11 with the rotor 14 protruding downward there through. The drive shaft 12 is coupled to the motor 10/gear head 13 shaft 14 thru a flexible coupling 15. The flexible coupling 15 may be almost any type of flexible coupling for transmitting the rotary motion, providing for misalignment between the two shafts, and is chosen in accordance with horsepower, torque, speed (RPM), shaft size, and environmental considerations.

The drive shaft 12 protrudes downward from the flexible coupling element 15 and traverses the entire hammering drill based ultrasonic/sonic actuator section 6, and is keyed into the drill bit 8.

Figure 4:
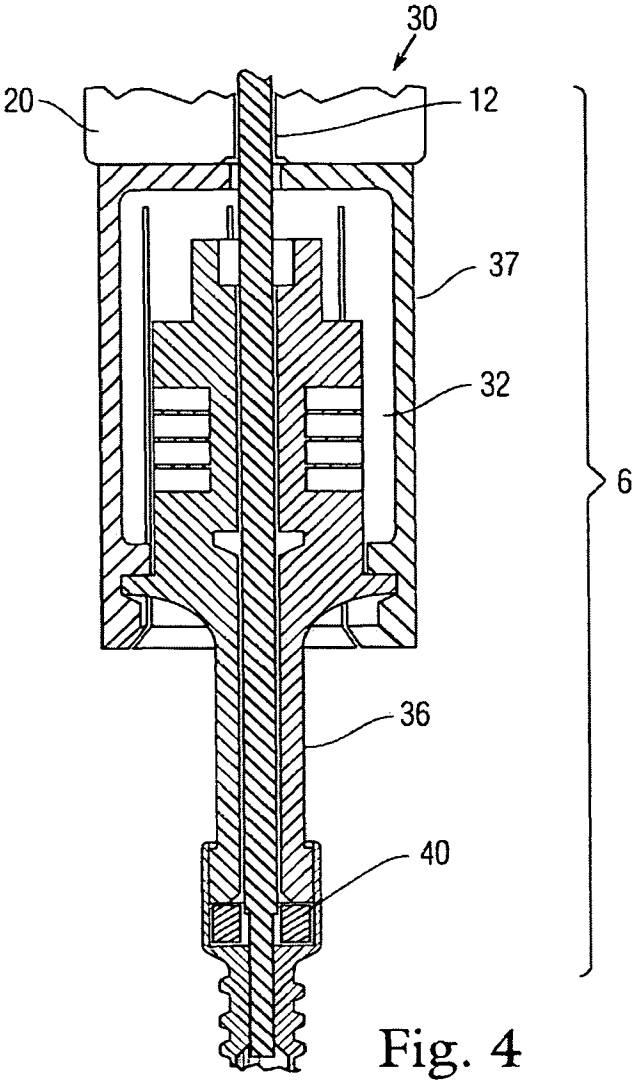
FIG. 4 is a close-up cross-section of the hammering drill based on ultrasonic/sonic actuator section 6 inclusive of the actuator 30.

FIG. 4 is a close-up cross-section of the hammering drill based ultrasonic/sonic actuator section 6 inclusive of the actuator 30. The actuator 30 comprises a piezoelectric stack 32 and ultrasonic transducer horn 36. The piezoelectric stack 32 further comprises piezoelectric rings arranged in a stack inside a housing 37. The illustrated embodiment employed 1.6 inch diameter rings. The actuator 30 is also formed with a cylindrical housing 37 and a set of preload weights 20 seated atop the actuator 30. In accordance with the present invention, all of the preload weights 20, the actuator 30 (inclusive of piezo stack 32 and housing 37) and the free mass 40 are defined by an axial thru-hole to allow the drive shaft 12 to pass thru and couple to the drill bit 8. The axial thru-hole may be of circular cross-section, the drive shaft 12 being an elongate cylindrical shaft with slightly smaller dimensions so as to rotate therein, and squared distal end to key it into the drill bit 8. The above-described drive shaft-drill bit coupling allows transmission of the rotation motion to the bit 8 while allowing the bit to move freely in the axial direction.

Figure 5:
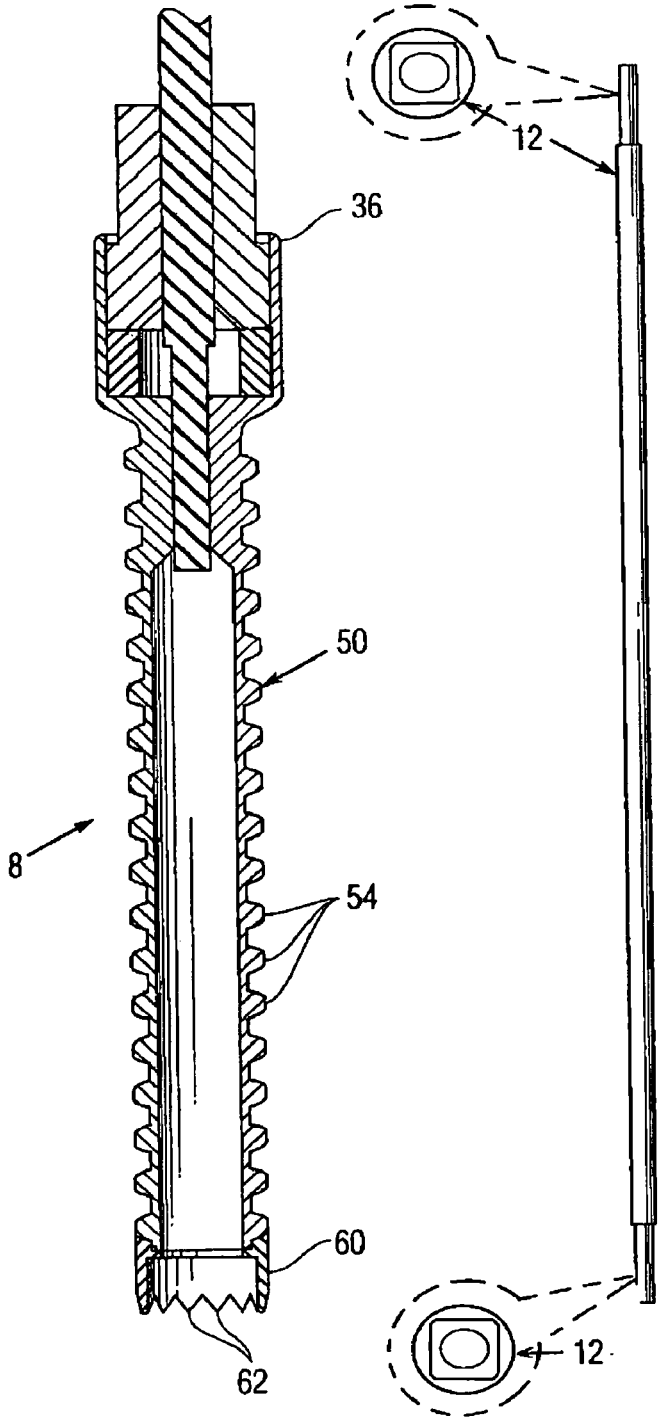
FIG. 5 is a side cross section of the drill bit 8.
Figure 6:
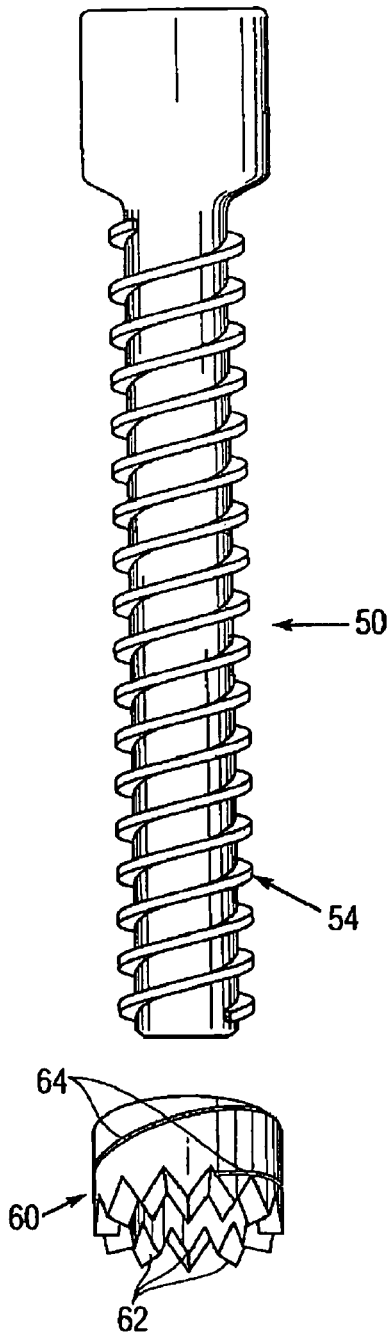
FIG. 6 is an exploded composite view of the component parts of the drill bit 8 plus drive shaft 12.

FIG. 5 is a side cross section of the drill bit 8, and FIG. 6 is an exploded composite view of the component parts of the drill bit 8 plus drive shaft 12. The drill bit 8 further comprises a distal crown cutter 60 attached to a drill stem 50, the latter communicating with the horn 36. The bit 8 is preferably formed from tungsten-carbide, but may be alternatively formed of various high stiffness materials, metal alloys or polymers. The drill bit 8 is fully scalable, and may be formed with a length of up to 5 feet and a diameter of between about 0.008 inches and about 30 inches.

The distal crown cutter 60 is a substantially annular member that forms a cap over the end of the drill stem 50. The annular crown cutter 60 has a cylindrical outer surface leading to a flat frontal array of circularly-oriented teeth 62. The teeth in its front surface help fracture the hammered surface. Thus, the edges of the teeth 62 protrude outward from the center along an axial pattern.

The drill stem 50 is formed with helical flutes 54 running downward lengthwise substantially the entire length to the crown cutter 60. The flute 54 has a helical configuration that spirals in a clockwise direction about longitudinal axis. The particular fluted configuration of the drill stem 50 outer surface facilitates transport of debris out of the hole.

The distal crown cutter 60 fits over the end of the drill stem 50 and is fixedly attached thereto. The cylindrical sides of the distal crown cutter 60 are likewise defined by a helical flute 64 running downward lengthwise, and adjoining the flute 54 on the stem 50. The flute 64 likewise has a helical configuration that spirals in a clockwise direction about longitudinal axis.

In operation, the crown cutter flute 64 on its external surface corresponds to the flute 54 on the drill stem 50 shaft and merges with it, this pattern increasing the speed of cuttings removal and hence the drilling speed (and depth of penetration). The extension of the flute 54 on the drill stem 50 onto the cutting crown 60 helps in this regard. One skilled in the art will readily understand that the shape and size of the fluted channel(s) 64 on the crown 60 can affect the cutting removal speed and can be optimized during design of the crown 60 itself.

If the stack is driven at the resonance frequency of 19.1 kHz, with a duty cycle of 20%, and a preload of 5 lbs, the drill is capable of reaching a depth of approximately 8.5-cm in a total continuous drilling time of 5 minutes. As it rotates the fluted bit 8 provides a removal path for the powdered cuttings to travel helically upward along the side of the stem 50 to the surface. The combined hammering with slow speed rotation rapidly produces powdered cuttings. Moreover, the decoupled rotation mechanism works independently of the sonic action and provides redundancy in case of a failure of one drilling mechanism. The crown cutter 60 provides a replaceable element for low cost operation.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. A drill, comprising:

a hammering section comprising an ultrasonic/sonic hammering actuator, an ultrasonic transducer horn, and a free mass moveable in an axial direction;

a rotary section including a motor coupled to a drive shaft that completely traverses said hammering drill section; and a drill bit rotatably coupled to said drive shaft and vibrationally coupled to said free mass for drilling by a combination of hammering and rotation.

2. The drill according to claim 1, wherein said hammering actuator is defined by an axial passage to allow the drive shaft to pass through and couple to the drill bit.

3. The drill according to claim 2, wherein said drive shaft comprises an elongate cylindrical shaft of smaller cross-section than said axial passage so as to rotate freely therein.

4. The drill according to claim 1, wherein said drill bit may be selectively rotated by said motor, or vibrated by said hammering actuator, or both.

5. The drill according to claim 1, wherein said drive shaft is coupled to said motor through a flexible coupling.

6. The drill according to claim 5, wherein said drive shaft is defined by rectilinear distal ends to key said ends into the drill bit and flexible coupling.

7. The drill according to claim 1, wherein said drill bit further comprises a distal crown cutter attached to a drill stem.

8. The drill according to claim 7, wherein said drill stem comprises a helical flute.

9. The drill according to claim 8, wherein said crown cutter comprises a helical flute continuation of the helical flute of said drill stem.

10. The drill according to claim 7, wherein said crown cutter comprises a frontal array of circularly-oriented teeth.

11. The drill according to claim 10, wherein said frontal array of teeth comprise sharp edges protruding outward from a common center along an axial pattern.

* * * * *